US005262748A

United States Patent [19]

Tsung-Mou

[11] Patent Number: 5,262,748

[45] Date of Patent: Nov. 16, 1993

[54] FUSELESS BREAKING SWITCH

[76] Inventor: Yu Tsung-Mou, No. 4, Alley 2, Lane 23, Sec. 3, Pa-Te Road, Pan-Chiao City, Taipei Hsien, Taiwan

[21] Appl. No.: 995,576

[22] Filed: Dec. 22, 1992

Related U.S. Application Data

[63] Continuation-in-part of Ser. No. 820,753, Jan. 13, 1992.

[51] Int. Cl.[5] ..... H01H 71/16

[52] U.S. Cl. ..... 337/66; 337/76

[58] Field of Search ..... 337/53, 66, 67, 68, 337/69, 74, 75, 140, 76

[56] References Cited

U.S. PATENT DOCUMENTS 3,846,729 11/1974 Sorimachi ..... 337/53

OTHER PUBLICATIONS

Bull Dog Electric Products Co. Bulletin No. 401 Apr. 12, 1940.

*Primary Examiner*—Harold Broome

*Attorney, Agent, or Firm*—Pro-Techtor International

[57] ABSTRACT

A fuseless breaking switch comprising essentially a casing, an alloy plate, a first and a second prong, and a spring blade. The switching on of the button allows a closed circuit through the alloy plate and the prongs. An overload of current will cause the alloy plate to flex and thus break the circuit.

2 Claims, 2 Drawing Sheets

FUSELESS BREAKING SWITCH

BACKGROUND OF THE INVENTION

This application is a continuation-in-part of application Ser. No. 07/820,753 filed Jan. 13, 1992.

The present invention relates generally to circuit breakers, and more particularly to a fuseless breaking switch having a simple structure, small in size, and able to automatically cut off current supply when overloaded.

Conventional breaking switches usually include fuses, and are generally of a complicated structure. A space within the switch must be provided to accommodate the fuse. In earlier types of breaking switches, the fuse was made from zinc. When the switch was overloaded, the fuse would melt. The dripping zinc created the possibility of a short circuit and presented a danger to the users. More recently, a type of fuseless breaking switch has been utilized. Such a switch can be used to protect the circuit from overload, but is not capable of cutting off the power in case of a fire, when it is imperative that the power be interrupted.

SUMMARY OF THE PRESENT INVENTION

It is therefore an object of the present invention to provide a fuseless breaking switch in which the structure is simple and functions effectively if overloaded.

Another object of the present invention is to provide a fuseless breaking switch structure in which the power supply will automatically cut off when the switch is overloaded.

A further feature of the present invention is a spring element that allows the automatic cut off of the current supply.

The above and other features of the invention, including various details of construction and combination of parts, will now be more particularly described with reference to the accompanying drawings, and pointed out in the claims. It will be understood that the particular structure embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the present invention from which its novel features and advantages will be apparent.

DESCRIPTION OF THE PREFERRED EMBODIMENT

Figure 1:
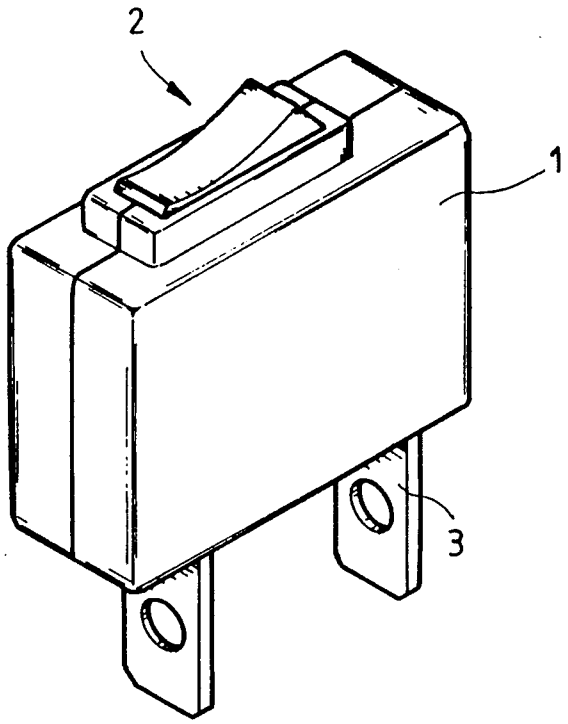
FIG. 1 is a perspective view of the fuseless breaking switch in accordance with the present invention.

Referring first to FIG. 1, it can be seen that the main components of the present invention are a casing 1, a pressure sensitive button 21 mounted at the center of casing 1, and a pair of electrically conductive prongs 3 and 3'.

Figure 3:
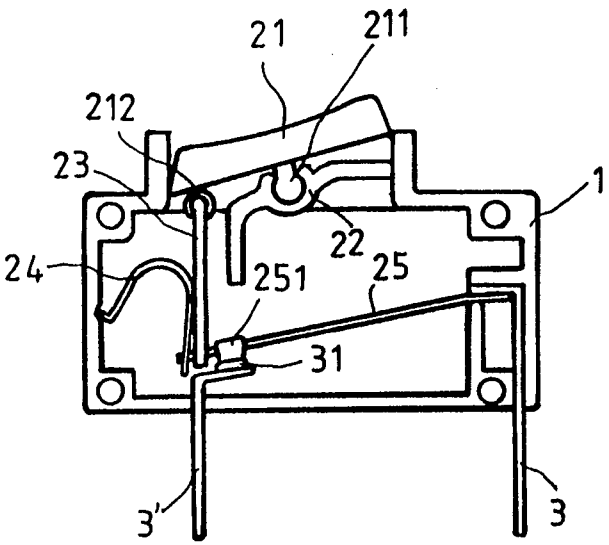
FIG. 3 is a cross-sectional view of the fuseless breaking switch structure in accordance with the present invention showing the switch its normal closed position.

Referring now to FIG. 3, it can be seen that when the button 21 is in its depressed position, a closed circuit is formed. When button 21 is depressed, a mounting rod 211 pivots in a blocking seat 22. The movement of the end of the button 21 urges rod 23 downward. The upper end of rod 23 is pivotally connected to the button 21 via a socket 212. The rod 23 is held in the depressed position by the combination of the downward force of a spring blade 24, and the inhibiting factors of blocking seat 22. The spring blade 24 is fixed at a first end to the casing 1 and at its other end to an alloy plate 25.

The lower end of rod 23 is attached to a first end of the alloy plate 25. Thus, the downward movement of the rod 23 when the button 21 is depressed forces the first end of a heat sensitive, electrically conductive alloy plate 25 to be pushed downward. Since a second end of the plate 25 is fixed in a slot in the casing 1, the plate 25 becomes slightly arched when the first end is forced downward. The downward movement also causes a conductive plate protrusion 251 to contact a conductive protrusion 31 of prong 3', completing the circuit between prongs 3 and 3'.

Figure 2:
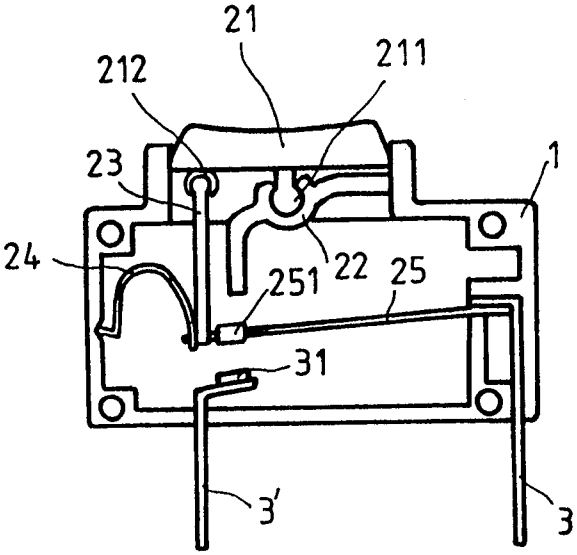
FIG. 2 is a cross-sectional view of the fuseless breaking switch structure in accordance with the present invention showing the switch in the position to break the circuit after overheating.

FIG. 2 shows the breaking switch after the circuit has been broken by overheating, either by current overload or by an external heat source such as a fire. The application of excessive heat causes the alloy plate 25 to expand, increasing its length. This forces the plate 25 to be arched further, and the resulting tension overcomes the downward force of the spring blade 24, allowing the switch to return to the position shown in FIG. 2, thus breaking the circuit completed by prongs 3 and 3' and plate 25.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

I claim:

1. A fuseless breaking switch comprising a casing, a button and a pair of prongs, characterized in that the button is mounted at the center of the casing, the bottom of the button is movably seated on a branched rod which is secured to the casing, a second rod is movably attached so as to communicate between the button and an alloy plate which is substantially perpendicular to the second rod, a first end of said alloy plate being attached to a spring blade and a second end of the alloy plate is affixed to the casing, wherein the alloy plate is situated such that the first end of the alloy plate abuts an end of the second rod, and a second end of the spring blade is affixed to the casing;

and wherein the pair of prongs are in electrically conductive communication with the alloy plate when the switch is in a closed position, the conductive communication being facilitated by a protrusion on one of the prongs which contacts a protrusion near the first end of the alloy plate.

2. The fuseless breaking switch as claimed in claim 1 wherein the prongs extend from the casing and are configured such that the switch may be plugged into a standard electrical outlet.

* * * * *